US012054313B2

(12) United States Patent
Frankenberg

(10) Patent No.: US 12,054,313 B2
(45) Date of Patent: Aug. 6, 2024

(54) TOTE WITH SIDE WALL DRAIN HOLES

(71) Applicant: ORBIS Corporation, Oconomowoc, WI (US)

(72) Inventor: Jason R. Frankenberg, Lake Mills, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 18/063,838

(22) Filed: Dec. 9, 2022

(65) Prior Publication Data

US 2023/0182963 A1 Jun. 15, 2023

Related U.S. Application Data

(60) Provisional application No. 63/265,598, filed on Dec. 17, 2021, provisional application No. 63/265,452, filed on Dec. 15, 2021.

(51) Int. Cl.
*B65D 25/38* (2006.01)
*B65D 25/08* (2006.01)

(52) U.S. Cl.
CPC ..... *B65D 25/38* (2013.01); *B65D 25/08* (2013.01)

(58) Field of Classification Search
CPC ..... B65D 1/243; B65D 25/04; B65D 25/08; B65D 25/38; B65D 81/261
See application file for complete search history.

(56) References Cited

U.S. PATENT DOCUMENTS

| | | | |
|---|---|---|---|
| 2,026,204 | A | 12/1935 | Andrews |
| 2,029,746 | A | 2/1936 | Nathan |
| 2,061,414 | A | 11/1936 | Nathan |
| 2,134,875 | A | 11/1938 | Henze |
| 2,457,841 | A | 1/1949 | Smith |
| 2,457,842 | A | 1/1949 | Smith |
| 2,609,120 | A | 9/1952 | Williams |
| 2,641,383 | A | 6/1953 | Coursey |
| 2,918,379 | A | 12/1959 | Lurie |
| 3,154,215 | A | 10/1964 | Le Vesconte |
| 3,286,877 | A | 11/1966 | Haimes |

(Continued)

FOREIGN PATENT DOCUMENTS

| | | | |
|---|---|---|---|
| CA | 892971 | A | 2/1972 |
| CA | 1273881 | A | 9/1990 |
| CA | 2032012 | A1 | 6/1991 |
| CA | 2129617 | A1 | 2/1995 |
| CA | 2130973 | A1 | 3/1995 |
| CA | 2212239 | A1 | 8/1996 |
| CA | 2484830 | A1 | 8/1996 |
| CA | 2313137 | A1 | 7/1999 |
| CA | 2296895 | A1 | 7/2000 |

(Continued)

OTHER PUBLICATIONS

European Patent Office, Partial European Search Report for EP Application No. 22213791.1, mailed May 11, 2023, 17 pages.

(Continued)

*Primary Examiner* — Andrew T Kirsch
(74) *Attorney, Agent, or Firm* — UB Greensfelder LLP; Richard C. Himelhoch

(57) ABSTRACT

A tote with a drainage system for evenly distributing water through all four sides is provided. The tote includes a first end wall, a second opposing end wall, a first side wall, a second opposing side wall, and a bottom wall. A bumper extends outward around the periphery of the tote. A plurality of D-shaped drain holes are positioned a first distance above the upper surface of the bottom wall which allow liquid in the tote to drain evenly out of the tote through the bumper.

20 Claims, 9 Drawing Sheets

(56) References Cited

U.S. PATENT DOCUMENTS 3,375,953 A 4/1968 Miller, Jr.
3,379,339 A 4/1968 Asenbauer
3,387,740 A 6/1968 Bockenstette
3,392,875 A 7/1968 Bockenstette
3,420,402 A 1/1969 Frater
3,421,656 A 1/1969 Asenbauer
3,570,697 A 3/1971 Langston
3,659,743 A 5/1972 Box
3,672,530 A 6/1972 Bridenstine
3,752,352 A 8/1973 Senecal
3,780,905 A 12/1973 Herolzer
D236,168 S 7/1975 Johnson
3,907,111 A 9/1975 Levenhagen
3,934,724 A 1/1976 Johnson
3,951,265 A 4/1976 Carroll
3,952,903 A 4/1976 Sanders
3,993,211 A 11/1976 Astle
4,000,817 A 1/1977 Sanders
4,093,070 A 6/1978 Stahl
4,093,071 A 6/1978 Stahl
4,102,453 A 7/1978 Carroll
4,105,117 A 8/1978 Atkin
4,106,623 A 8/1978 Carroll
4,106,624 A 8/1978 Thurman
4,106,625 A 8/1978 Carroll
4,109,791 A 8/1978 Clipson
4,189,052 A 2/1980 Carroll
4,194,626 A 3/1980 Boller
4,211,327 A 7/1980 Blair
D258,050 S 1/1981 Cornou
4,247,004 A 1/1981 Bird
4,316,154 A 2/1982 Krause
4,320,837 A 3/1982 Carroll
4,391,369 A 7/1983 Stahl
4,423,813 A 1/1984 Kreeger
4,426,001 A 1/1984 Stahl
4,440,302 A 4/1984 Ehrman
4,466,541 A 8/1984 Tabler
4,499,997 A 2/1985 Swingley, Jr.
4,520,928 A 6/1985 Wilson
4,523,681 A 6/1985 Kreeger
4,527,222 A * 7/1985 Swingley, Jr. ..... H05K 13/0069 206/832
4,573,577 A 3/1986 Miller
4,577,759 A 3/1986 Kreeger
4,588,087 A 5/1986 Swingley, Jr.
4,600,103 A 7/1986 Tabler
4,601,393 A 7/1986 Veenman
RE32,223 E 8/1986 Kreeger
4,619,366 A 10/1986 Kreeger
4,619,371 A 10/1986 Rehrig
4,643,310 A 2/1987 Deaton
4,671,411 A 6/1987 Rehrig
D292,634 S 11/1987 Chabot
4,759,451 A 7/1988 Apps
4,848,578 A 7/1989 Schaefer
4,863,062 A 9/1989 Holliday
4,905,833 A 3/1990 Kreeger
4,936,458 A 6/1990 Tabler
4,947,992 A 8/1990 Schaefer
4,960,207 A 10/1990 Tabler
4,982,844 A 1/1991 Madan
5,035,326 A 7/1991 Stahl
D319,908 S 9/1991 Stahl
D320,298 S 9/1991 Apps
5,163,587 A 11/1992 Apps
D343,042 S 1/1994 Apps
D344,387 S 2/1994 Holliday
5,287,966 A 2/1994 Stahl
D348,138 S 6/1994 Lang-Ree
D348,342 S 6/1994 Lang-Ree
D348,343 S 6/1994 Lang-Ree
D350,028 S 8/1994 Apps
5,339,676 A 8/1994 Johnson
D350,437 S 9/1994 Apps
5,344,021 A 9/1994 Rose
5,344,022 A 9/1994 Stahl
5,372,257 A 12/1994 Beauchamp
D354,167 S 1/1995 Stahl
5,377,858 A 1/1995 Morris, Sr.
5,392,915 A 2/1995 Kalin
5,415,293 A 5/1995 Ackermann
5,452,739 A 9/1995 Mustee
5,456,379 A 10/1995 Krupa
5,469,986 A 11/1995 Jang
5,494,163 A 2/1996 Apps
5,527,052 A 6/1996 Litin
D374,555 S 10/1996 McMath
5,582,296 A 12/1996 Beauchamp
5,584,412 A 12/1996 Wang
5,594,207 A 1/1997 Fabian
5,609,254 A 3/1997 Loftus
5,615,798 A 4/1997 Luburic
5,617,953 A 4/1997 Cope
D379,718 S 6/1997 Raghunathan
D381,203 S 7/1997 Ackermann
D382,404 S 8/1997 Cope
D384,975 S 10/1997 Jackson
5,735,431 A 4/1998 Letrudet
5,752,602 A 5/1998 Ackermann
5,772,033 A 6/1998 Loftus
D398,448 S 9/1998 Zanni
D400,711 S 11/1998 Hwang
D401,066 S 11/1998 Ackermann
D401,412 S 11/1998 Letrudet
5,860,527 A 1/1999 Frankenberg
5,881,902 A 3/1999 Ackermann
5,896,987 A 4/1999 Bettenhausen
5,896,992 A 4/1999 McGrath
5,908,133 A 6/1999 Luburic
5,924,572 A 7/1999 Cope
5,975,324 A 11/1999 Schmitt
5,992,673 A 11/1999 Hwang
6,015,056 A 1/2000 Overholt
D420,219 S 2/2000 Elvin-Jensen
6,036,049 A 3/2000 Hwang
D423,217 S 4/2000 Varfeldt
D424,299 S 5/2000 Varfeldt
6,059,114 A 5/2000 Loftus
6,089,373 A 7/2000 Cope
D429,565 S 8/2000 Aiken
6,098,827 A 8/2000 Overholt
6,138,863 A 10/2000 Aiken
D436,729 S 1/2001 Aiken
D439,049 S 3/2001 Koefelda
6,209,742 B1 4/2001 Overholt
6,250,490 B1 6/2001 Loftus
6,260,706 B1 7/2001 Koefelda
D446,017 S 8/2001 Koefelda
D446,392 S 8/2001 Overholt
D446,939 S 8/2001 Koefelda
6,273,259 B1 8/2001 Stahl
6,293,418 B1 9/2001 Ogden
6,308,858 B1 10/2001 Koefelda
D452,614 S 1/2002 Overholt
6,338,181 B1 1/2002 Hwang
6,386,388 B1 5/2002 Overholt
6,394,274 B1 5/2002 Cheeseman
D458,753 S 6/2002 Overholt
6,398,054 B1 6/2002 Overholt
6,405,888 B1 6/2002 Overholt
6,409,041 B1 6/2002 Overholt
D460,619 S 7/2002 Koefelda
D463,667 S 10/2002 Hwang
6,460,717 B1 10/2002 Smyers
D478,421 S 8/2003 Overholt
6,601,724 B1 8/2003 Koefelda
6,607,199 B2 8/2003 Gruber
6,631,822 B1 10/2003 Overholt
D487,634 S 3/2004 Apps
6,719,164 B2 4/2004 Maschio
6,843,386 B2 1/2005 Raghunathan
6,857,642 B2 2/2005 Gruber
6,863,180 B2 3/2005 Apps

(56) References Cited

U.S. PATENT DOCUMENTS

| | | | |
|---|---|---|---|
| 6,880,705 | B2 | 4/2005 | Oetting |
| 6,886,710 | B2 | 5/2005 | Verna |
| 6,899,242 | B2 | 5/2005 | Overholt |
| 6,918,508 | B2 | 7/2005 | Hwang |
| 6,938,772 | B2 | 9/2005 | Aiken |
| 6,994,216 | B2 | 2/2006 | Wong |
| 7,014,043 | B2 | 3/2006 | Raghunathan |
| 7,017,745 | B2 | 3/2006 | Raghunathan |
| 7,017,766 | B2 | 3/2006 | Hsu |
| 7,044,319 | B2 | 5/2006 | Overholt |
| 7,048,134 | B1 | 5/2006 | Hagan |
| 7,048,135 | B2 | 5/2006 | Smyers |
| 7,059,489 | B2 | 6/2006 | Apps |
| 7,063,210 | B2 | 6/2006 | Smyers |
| 7,086,555 | B2 | 8/2006 | Overholt |
| 7,100,786 | B2 | 9/2006 | Smyers |
| 7,104,414 | B2 | 9/2006 | Apps |
| 7,104,553 | B2 | 9/2006 | Gruber |
| 7,128,231 | B2 | 10/2006 | Overholt |
| 7,195,127 | B2 | 3/2007 | Hsu |
| 7,234,599 | B2 | 6/2007 | Hassell |
| 7,264,122 | B2 | 9/2007 | Koefelda |
| 8,833,594 | B2 | 9/2014 | Stahl |
| 9,540,140 | B2 | 1/2017 | Hassell |
| 10,611,547 | B2 | 4/2020 | Apps |
| 2002/0056717 | A1 | 5/2002 | Hwang |
| 2002/0130132 | A1 | 9/2002 | Overholt |
| 2002/0148842 | A1 | 10/2002 | Overholt |
| 2002/0153682 | A1 | 10/2002 | Gruber |
| 2002/0158067 | A1 | 10/2002 | Overholt |
| 2002/0179480 | A1 | 12/2002 | Raghunathan |
| 2003/0024845 | A1 | 2/2003 | Smyers |
| 2003/0042255 | A1 | 3/2003 | Smyers |
| 2003/0116564 | A1 | 6/2003 | Overholt |
| 2003/0132228 | A1 | 7/2003 | Apps |
| 2003/0155275 | A1 | 8/2003 | Apps |
| 2003/0222081 | A1 | 12/2003 | Apps |
| 2003/0230510 | A1 | 12/2003 | Aiken |
| 2004/0020821 | A1 | 2/2004 | Koefelda |
| 2004/0050742 | A1 | 3/2004 | Gruber |
| 2004/0060844 | A1 | 4/2004 | Stahl |
| 2004/0069780 | A1 | 4/2004 | Apps |
| 2004/0099563 | A1 | 5/2004 | Otting |
| 2004/0099662 | A1 | 5/2004 | Overholt |
| 2004/0104231 | A1 | 6/2004 | Hassell |
| 2004/0144680 | A1 | 7/2004 | Stahl |
| 2004/0155048 | A1 | 8/2004 | R Aiken |
| 2004/0178197 | A1 | 9/2004 | Hsu |
| 2004/0182858 | A1 | 9/2004 | Smyers |
| 2004/0195139 | A1 | 10/2004 | Wong |
| 2004/0226945 | A1 | 11/2004 | Hsu |
| 2004/0245142 | A1 | 12/2004 | Raghunathan |
| 2005/0140107 | A1 | 6/2005 | Gruber |
| 2005/0183980 | A1 | 8/2005 | Fernandez |
| 2005/0224385 | A1 | 10/2005 | Hassell |
| 2005/0263423 | A1 | 12/2005 | Hassell |
| 2005/0263424 | A1 | 12/2005 | Hassell |
| 2006/0011627 | A1 | 1/2006 | Overholt |
| 2006/0065567 | A1 | 3/2006 | Hassell |
| 2006/0070906 | A1 | 4/2006 | Verna |
| 2006/0096883 | A1 | 5/2006 | Raghunathan |
| 2006/0108372 | A1 | 5/2006 | Aiken |
| 2006/0118450 | A1 | 6/2006 | Stahl |
| 2006/0180491 | A1 | 8/2006 | Zephir |
| 2006/0186123 | A1 | 8/2006 | Baltz |
| 2006/0196800 | A1 | 9/2006 | Baltz |
| 2006/0231449 | A1 | 10/2006 | Hassell |
| 2006/0231555 | A1 | 10/2006 | Smyers |
| 2006/0237341 | A1 | 10/2006 | McDade |
| 2007/0056874 | A1 | 3/2007 | Apps |
| 2007/0144931 | A1 | 6/2007 | McTavish |
| 2007/0175790 | A1 | 8/2007 | Fernandez |
| 2007/0178197 | A1 | 8/2007 | Larue |
| 2007/0187276 | A1 | 8/2007 | Stahl |
| 2007/0246471 | A1 | 10/2007 | Hrovat |
| 2008/0023426 | A1 | 1/2008 | Stahl |
| 2018/0362212 | A1 | 12/2018 | Bahr |
| 2021/0229863 | A1 | 7/2021 | Sostmann |

FOREIGN PATENT DOCUMENTS

| | | | |
|---|---|---|---|
| CA | 2326118 | A1 | 5/2001 |
| CA | 2387491 | A1 | 5/2001 |
| CA | 2389010 | A1 | 5/2001 |
| CA | 2392265 | A1 | 6/2001 |
| CA | 2395367 | A1 | 7/2001 |
| CA | 2397522 | A1 | 8/2001 |
| CA | 2406099 | A1 | 10/2001 |
| CA | 2408247 | A1 | 11/2001 |
| CA | 2384941 | A1 | 1/2002 |
| CA | 2421595 | A1 | 3/2002 |
| CA | 2426949 | A1 | 5/2002 |
| CA | 2367649 | A1 | 7/2002 |
| CA | 2442723 | A1 | 10/2002 |
| CA | 2455355 | A1 | 2/2003 |
| CA | 2458773 | A1 | 3/2003 |
| CA | 2472360 | A1 | 7/2003 |
| CA | 2475531 | A1 | 9/2003 |
| CA | 2485544 | A1 | 12/2003 |
| CA | 2448920 | A1 | 7/2004 |
| CA | 2431444 | A1 | 12/2004 |
| DE | 1840375 | U | 10/1961 |
| DE | 1941280 | U | 6/1966 |
| DE | 3511321 | A1 | 10/1986 |
| DE | 3521894 | A1 | 1/1987 |
| DE | 20002537 | U1 | 6/2001 |
| EP | 0368713 | A1 | 5/1990 |
| EP | 0370771 | A2 | 5/1990 |
| EP | 0557002 | A1 | 8/1993 |
| EP | 0697341 | A1 | 2/1996 |
| EP | 0926073 | A1 | 6/1999 |
| EP | 0953509 | A1 | 11/1999 |
| EP | 4197932 | A2 | 6/2023 |
| FR | 1131652 | A | 2/1957 |
| FR | 2678585 | A1 | 1/1993 |
| GB | 2067167 | A | 7/1981 |
| GB | 2124588 | A | 2/1984 |
| GB | 2129401 | A | 5/1984 |
| GB | 2137167 | A | 10/1984 |
| GB | 2141778 | A | 1/1985 |
| GB | 2171980 | A | 9/1986 |
| GB | 2180821 | A | 4/1987 |
| GB | 2209737 | A | 5/1989 |
| GB | 2296009 | A | 6/1996 |
| GB | 2333285 | A | 7/1999 |
| GB | 2340485 | A | 2/2000 |
| GB | 2350350 | A | 11/2000 |
| GB | 2373239 | A | 9/2002 |
| GB | 2373240 | A | 9/2002 |
| GB | 2374859 | A | 10/2002 |
| NL | 7905105 | A | 12/1980 |
| TW | 338405 | U | 8/1998 |
| TW | 372539 | U | 10/1999 |
| WO | 9801352 | A1 | 1/1998 |
| WO | 0027716 | A1 | 5/2000 |
| WO | 0051900 | A1 | 9/2000 |
| WO | 0066440 | A1 | 11/2000 |
| WO | 0185558 | A2 | 11/2001 |
| WO | 2006062899 | A2 | 6/2006 |
| WO | 2008013574 | A2 | 1/2008 |

OTHER PUBLICATIONS

European Patent Office, Extended European Search Report for EP Application No. 22213791.1, mailed Jul. 24, 2023, 14 pages.

* cited by examiner

TOTE WITH SIDE WALL DRAIN HOLES

CROSS-REFERENCE TO RELATED APPLICATIONS

The present invention claims priority to and the benefit of U.S. Provisional Patent Application Nos. 63/265,598 filed Dec. 17, 2021 and 63/265,452 filed Dec. 15, 2021, the contents of which are incorporated herein by reference and made a part hereof.

FEDERALLY SPONSORED RESEARCH OR DEVELOPMENT

N/A

FIELD OF THE INVENTION

The present invention is generally directed to a drainage system for a tote, and more particularly, to a tote having a plurality of drain holes in the end and side walls configured to allow drainage of liquid through a bumper on the lower portion of the walls.

DESCRIPTION OF THE PRIOR ART

Totes and other similar containers are a primary packaging product used in the industry to distribute a wide array of products. The totes are typically used in a returnable loop automatic storage and retrieval system (ASRS) where they are used to fulfill orders for inventory.

When the totes are stored in an ASRS system it's required that water is not retained in the tote during a fire detection incident where the sprinklers would be activated. Typically, totes used in this type of application usually have drain holes in the sides and/or bottom that are very simplistic and do not optimize water dispersion. An excess accumulation of water in the tote can also cause racking failures due to weight buildup of water within the totes.

The present invention provides a design to optimize evacuation of water during a fire suppression occurrence. In the new design, water is forced to accumulate in the bottom of the tote before draining out all four sides in an evenly distributed pattern.

SUMMARY OF THE INVENTION

The present invention is generally directed to a drainage system for a tote to allow even flow of a liquid in the interior of the tote. The system includes a plurality of drain holes in the walls of the tote spaced a first distance above the surface of the bottom wall. The drain holes are configured to allow the flow of any liquid in the interior of the container out through a bumper extending around the outer periphery of the tote. The system requires first allowing the liquid to accumulate in the bottom of the tote before evenly exiting the tote through the drain holes and bumper. The drain holes are configured to have a D-shaped opening (on its side) to facilitate the even flow of the liquid through all sides of the bumper and out past the foot print of the tote.

Specifically, in accordance with the design of the present invention, water is forced to accumulate in the bottom of the tote before draining out the sides in an evenly distributed pattern while not exceeding more than about 0.50 inches of water within the tote at any given time. The drainage of water is forced out through the bumper and towards the outside of the tote perimeter, without allowing the water to drain back into stacked or placed totes below.

In accordance with one aspect of the invention, a tote with a drainage system for enabling even flow of liquid out of the tote is provided. The tote comprises a container body having a first end wall, an opposing second end wall, a first side wall and an opposing second side wall extending upwards from a bottom wall. A bumper extends outward from the first end wall, second end wall, first side wall and second side wall around a lower portion of the container body. At least a first drain hole is in the first end wall spaced a first distance above a top surface of the bottom wall allowing liquid from an interior of the container body to exit through the bumper. Similarly, at least a first drain hole is in the second end wall spaced the first distance above the top surface allowing liquid from the interior of the container body to exit through the bumper, as well as a first drain hole is in the first side wall spaced the first distance above the top surface allowing liquid from the interior of the container body to exit through the bumper; and a first drain hole is in the second side wall spaced the first distance above the top surface allowing liquid from the interior of the container body to exit through the bumper. The tote is configured to accumulate liquid in a bottom portion of the container body below the first distance before drainage occurs.

The tote also includes a plurality of ribs extending upward from the top surface of the bottom wall. The plurality of ribs comprises a plurality of spaced apart parallel ribs extending from proximate the first end wall to proximate the second end wall, and a plurality of spaced apart parallel ribs extending from proximate the first side wall to proximate the second side wall. The ribs form a grid like pattern on the bottom wall. The ribs are configured to extend upward a second distance that is less than the first distance.

The tote can be designed such that the first distance is 0.5 inches and the second distance is 0.45 inches. With these measurements, the ribs will completely fill with any liquid in the container body (e.g., water) before being drained through the drain holes.

The first end wall can include a second drain hole spaced the first distance above the top surface, or more for allowing liquid from the interior of the container body to exit through the bumper. Similarly, the second end wall, first side wall and second side wall can also a second drain hole spaced the first distance above the top surface, or more for allowing liquid from the interior of the container body to exit through the bumper.

Each of the drain holes can have a D-shaped opening. In this instance, the opening can have a flat segment and an arcuate segment connected at a first end to a first end of the flat segment and at a second end to a second end of the flat segment. The flat segment can be oriented to a horizontal position with the arcuate segment above the flat segment.

The bumper can include a first horizontal upper wall extending outward from the container body and a second lower horizontal wall extending outward from the container body. The drain holes can be positioned between the first wall of the bumper and the second wall of the bumper. Additionally, the bumper can include a plurality of segments extending outwardly from the container body between the drain holes.

In accordance with another aspect of the invention, a tote having a drainage system is provided. The tote comprises a container body having a first end wall, an opposing second end wall, a first side wall and an opposing second side wall extending upwards from a bottom wall. A bumper extends outward from the first end wall, second end wall, first side wall and second side wall around a lower portion of the container body. A first plurality of drain holes are in the first end wall spaced a first distance above a top surface of the bottom wall allowing liquid from an interior of the container body to exit through the bumper. A second plurality of drain holes are in the second end wall spaced the first distance above the top surface allowing liquid from the interior of the container body to exit through the bumper. A third plurality of drain holes are in the first side wall spaced the first distance above the top surface allowing liquid from the interior of the container body to exit through the bumper and a fourth plurality of drain holes are in the second side wall spaced the first distance above the top surface. The drain holes allow liquid from the interior of the container body to exit through the bumper. The tote is configured to accumulate liquid in a bottom portion of the container body below the first distance before drainage occurs. The drain holes and bumper can be configured as noted.

The tote can be formed from a molded plastic. Other similar or suitable materials can also be used.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 1:
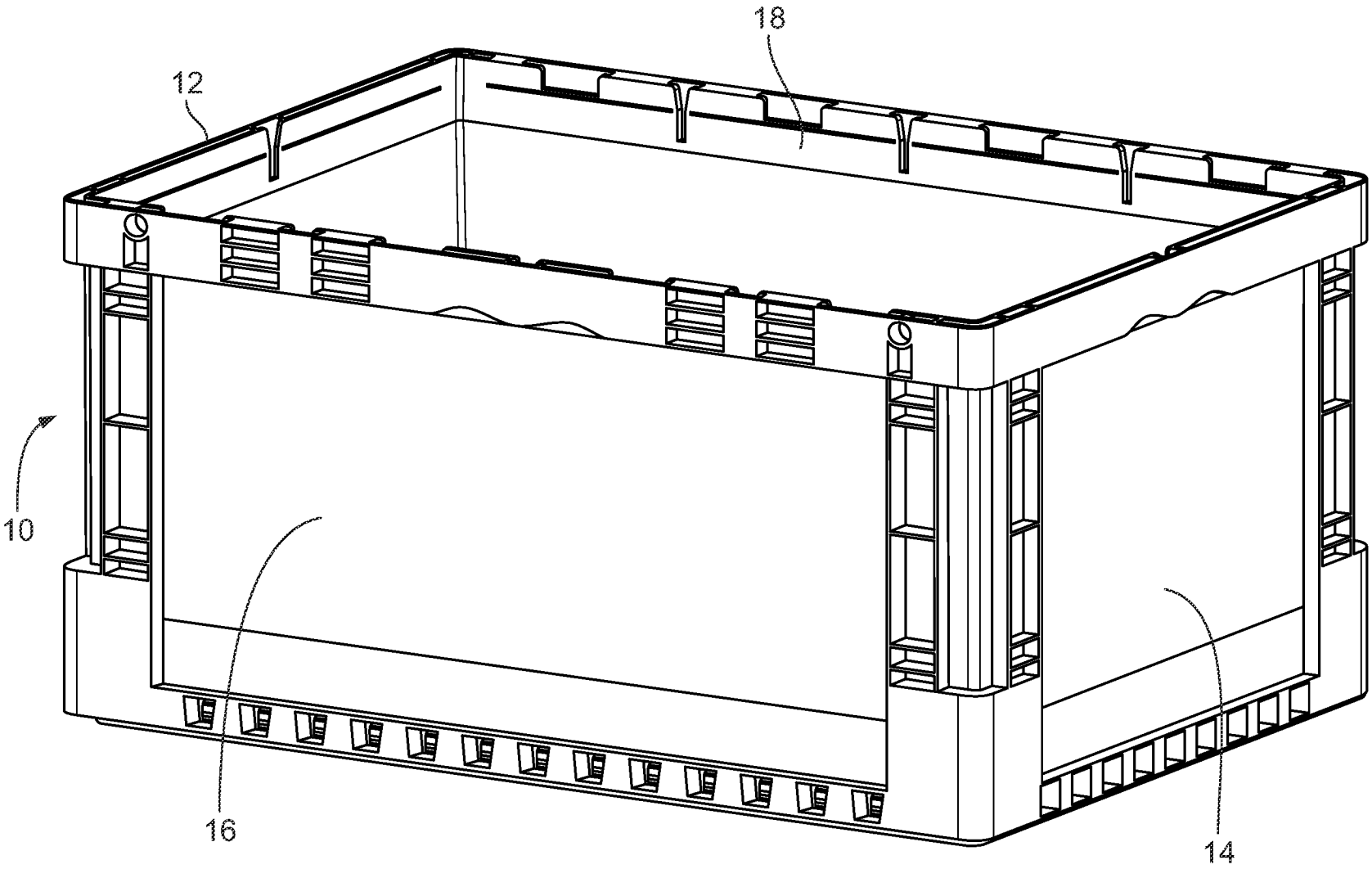
FIG. 1 is a perspective view of a tote with a drainage system in accordance with the present invention.
Figure 2:
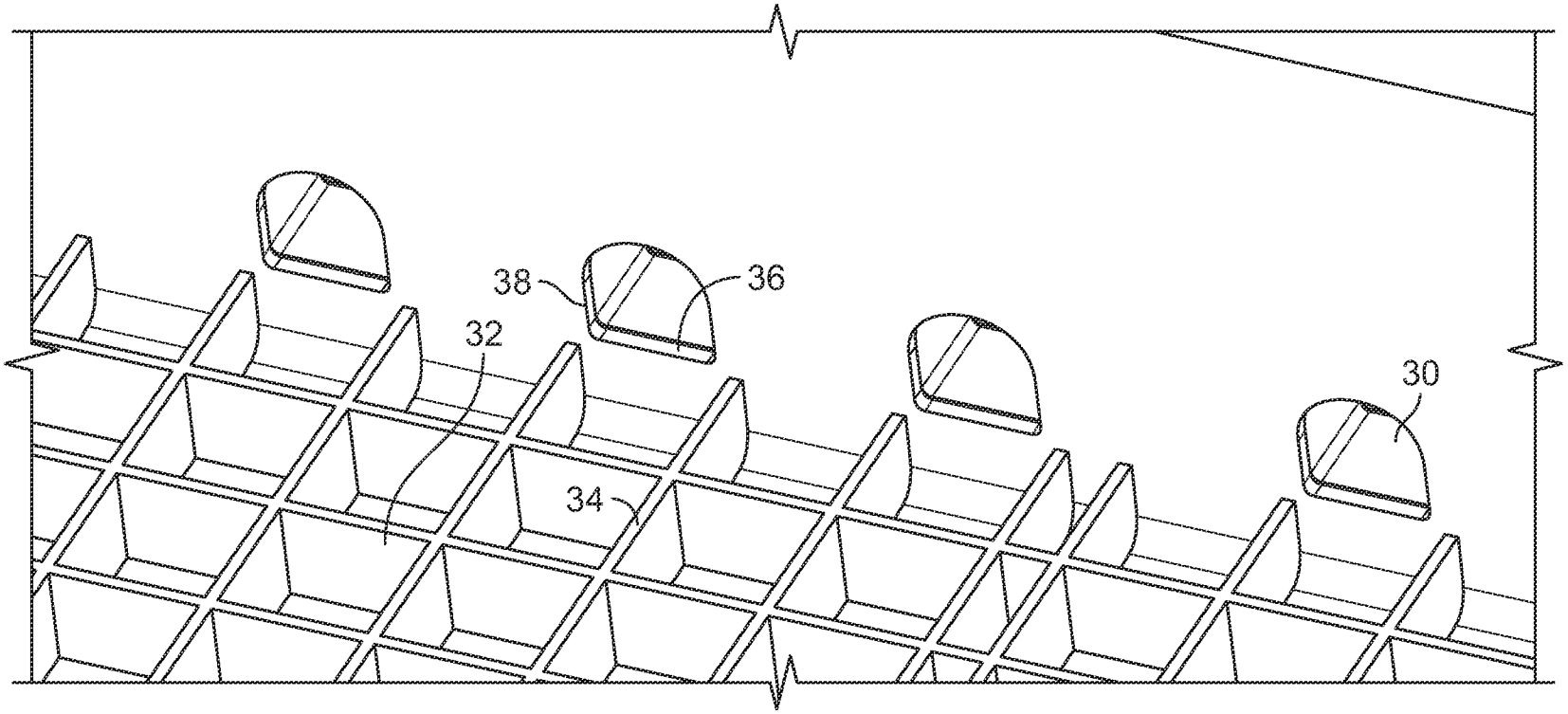
FIG. 2 is a partial perspective view of a lower interior portion of the tote of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-6 show aspects of an embodiment of a tote 10 with a drainage system for allowing a liquid to drain out evenly from an interior of the tote in accordance with the present invention. The tote 10 is in the form of a unitary container body having a first end wall 12, a second end wall 14 opposing the first end wall 12, a first side wall 16 and a second side wall 18 opposing the first side wall 16. All of the walls 12, 14, 16, 18 extend upward from a generally rectangular bottom wall 20.

Figure 3:
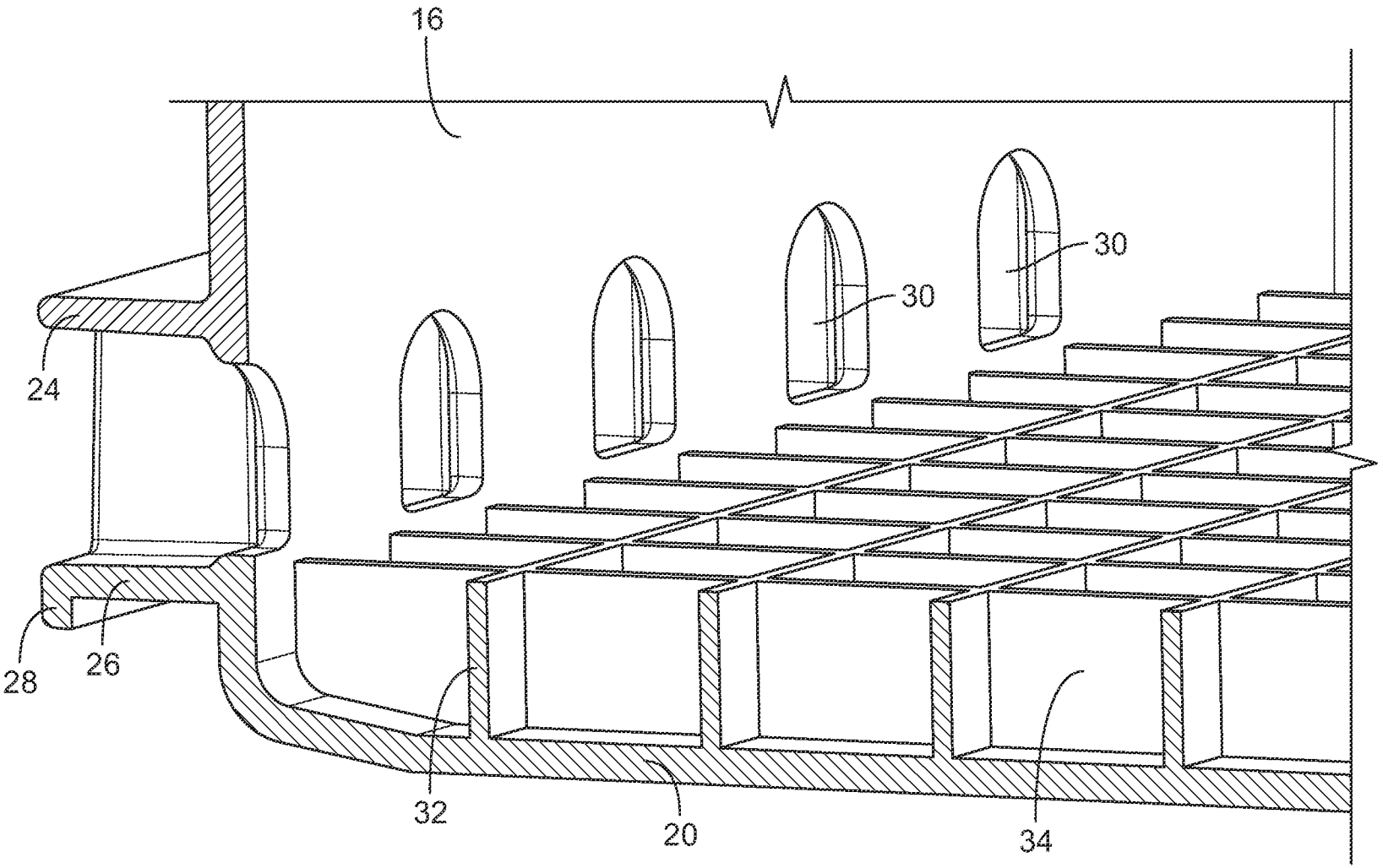
FIG. 3 is a partial perspective cross-sectional view of a lower interior portion of the tote of FIG. 1.
Figure 4:
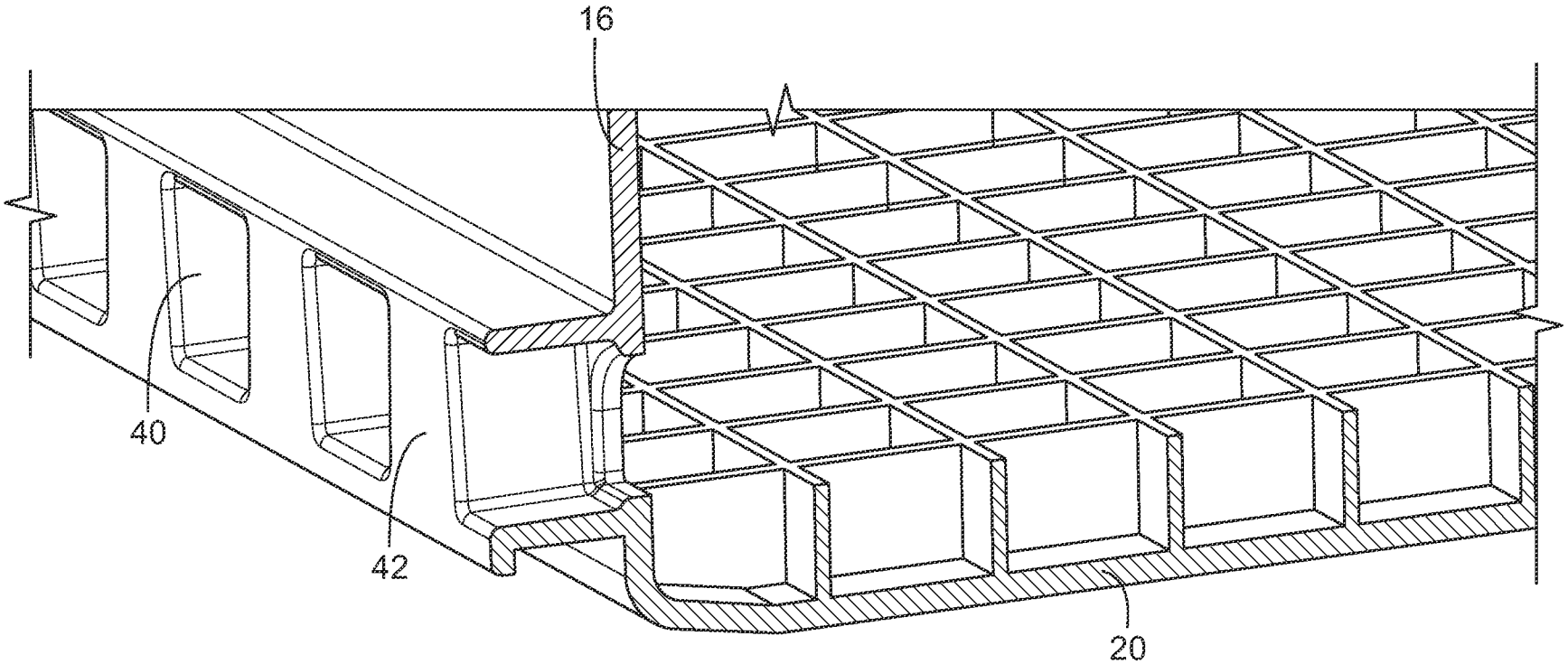
FIG. 4 is a partial perspective cross-sectional view of a lower exterior and interior portion of the tote of FIG. 1
Figure 5:
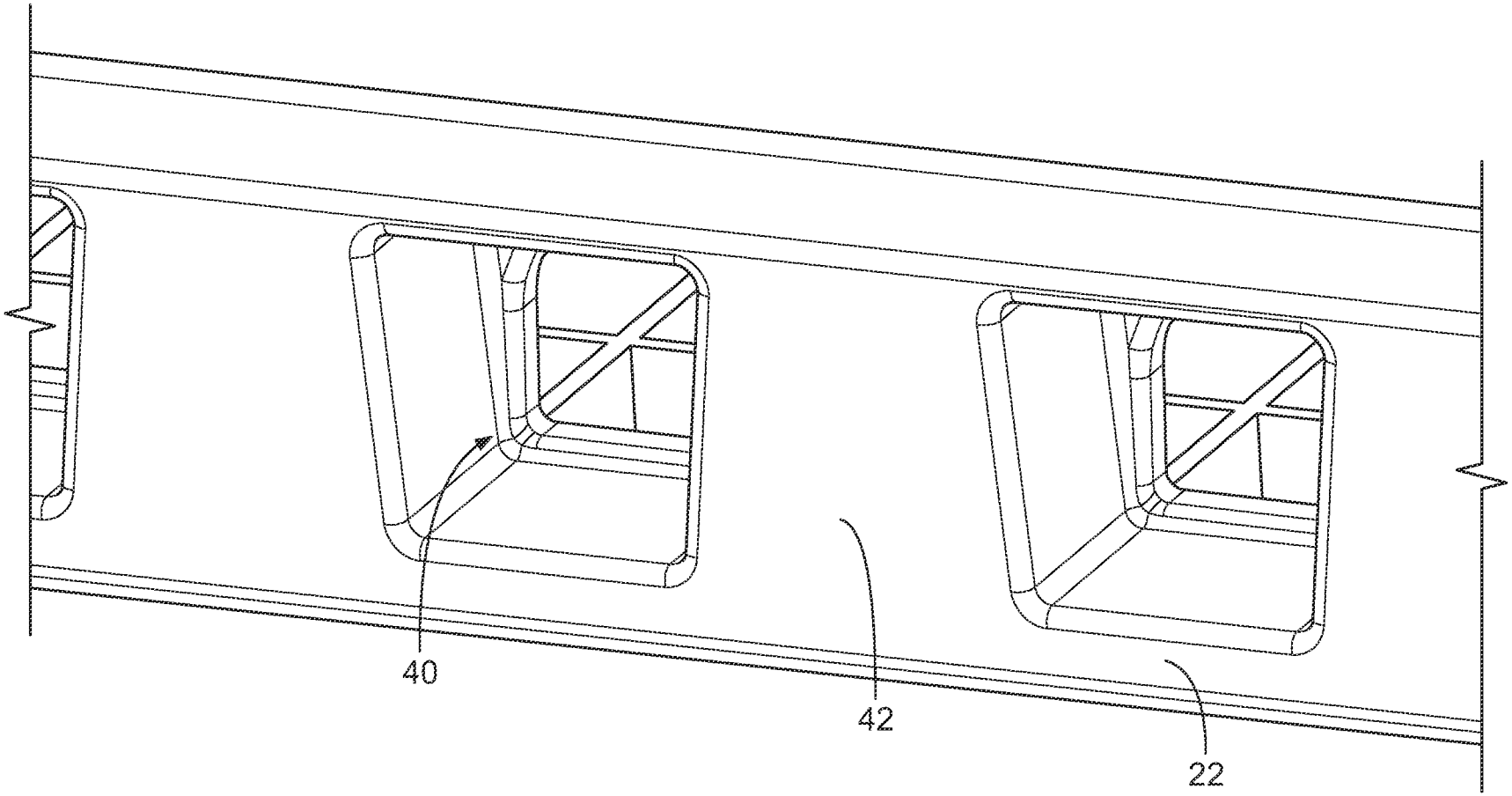
FIG. 5 is an enlarged partial perspective view of an exterior portion of the bumper of the tote of FIG. 1.
Figure 6:
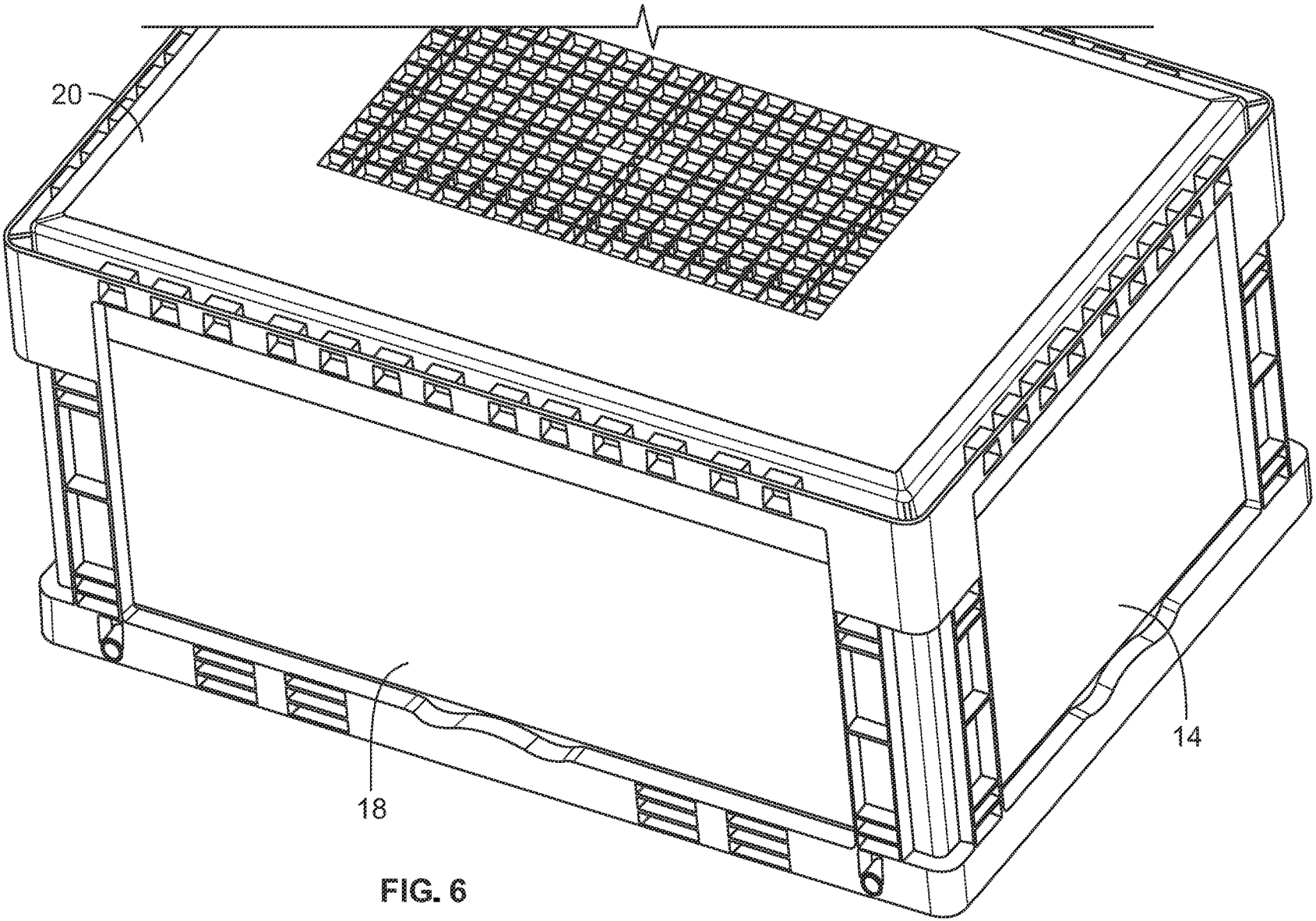
FIG. 6 is a perspective upside down view of the tote of FIG. 1.

The container body includes a bumper 22 extending continuously around a bottom portion of each of the end and side walls 12, 14, 16, 18. The bumper 22 extends outward from the walls 12, 14, 16, 18, and includes a top horizontal wall 24 and a bottom horizontal wall 26 having a downwardly directed lip 28 as shown in FIG. 3. The top horizontal wall 24 is spaced a distance above the bottom horizontal wall 28.

The container body also includes a plurality of drain holes 30 positioned proximate the bottom of each of the end and side walls 12, 14, 16, 18. The drain holes 30 are positioned a first distance above a top surface of the bottom wall 20. In the embodiment illustrated, the bottom of each drain hole 30 is about 0.50 inches from the top surface of the bottom wall 20. This distance aligns the drain holes 30 so that they are in between the top horizontal wall 24 and the bottom horizontal wall 26 of the bumper 22 as shown, for example, in FIG. 3.

The bottom wall 20 of the tote includes a plurality of ribs 32, 34 extending upward from the top surface of the bottom wall 20. A first set of the ribs 32 are generally parallel to each other and extend from proximate the first end wall 12 to proximate the second end wall 14, and a second set of the ribs 34 are generally parallel to each other and extend from proximate the first side wall 16 to proximate the second side wall 18. This forms a grid pattern on the bottom wall 20. The ribs extend upward a second distance that is slightly less than the bottom of the drain holes 30. In the embodiment shown the ribs extend upward approximately 0.45 inches. In view of these dimensions, the ribbed portion of the bottom wall 20 will completely fill with any liquid (e.g., water) before allowing the liquid to drain evenly through the drain holes 30 and out through the bumper 22.

The drain holes 30 are formed to have a D-shaped opening (with the D-shape on its side). Each drain hole 30 includes a flat segment 36 connected at each end to an end of an arcuate shaped segment 38.

The bumper 22 is designed to include openings 40 that are aligned with the drain holes 30. The openings 40 have a generally trapezoidal shape. Segments 42 extending between the top horizontal wall 24 and the bottom horizontal wall 26 are formed between adjacent drain holes 30 and openings 40 in the bumper 22.

The tote is preferably formed from a molded plastic, or other similar or suitable materials.

Directional words such as top, bottom, upper etc. are used herein to describe the invention as shown in the drawings and as typically used, and are not meant to limit the invention to being in such positions.

Figure 7:
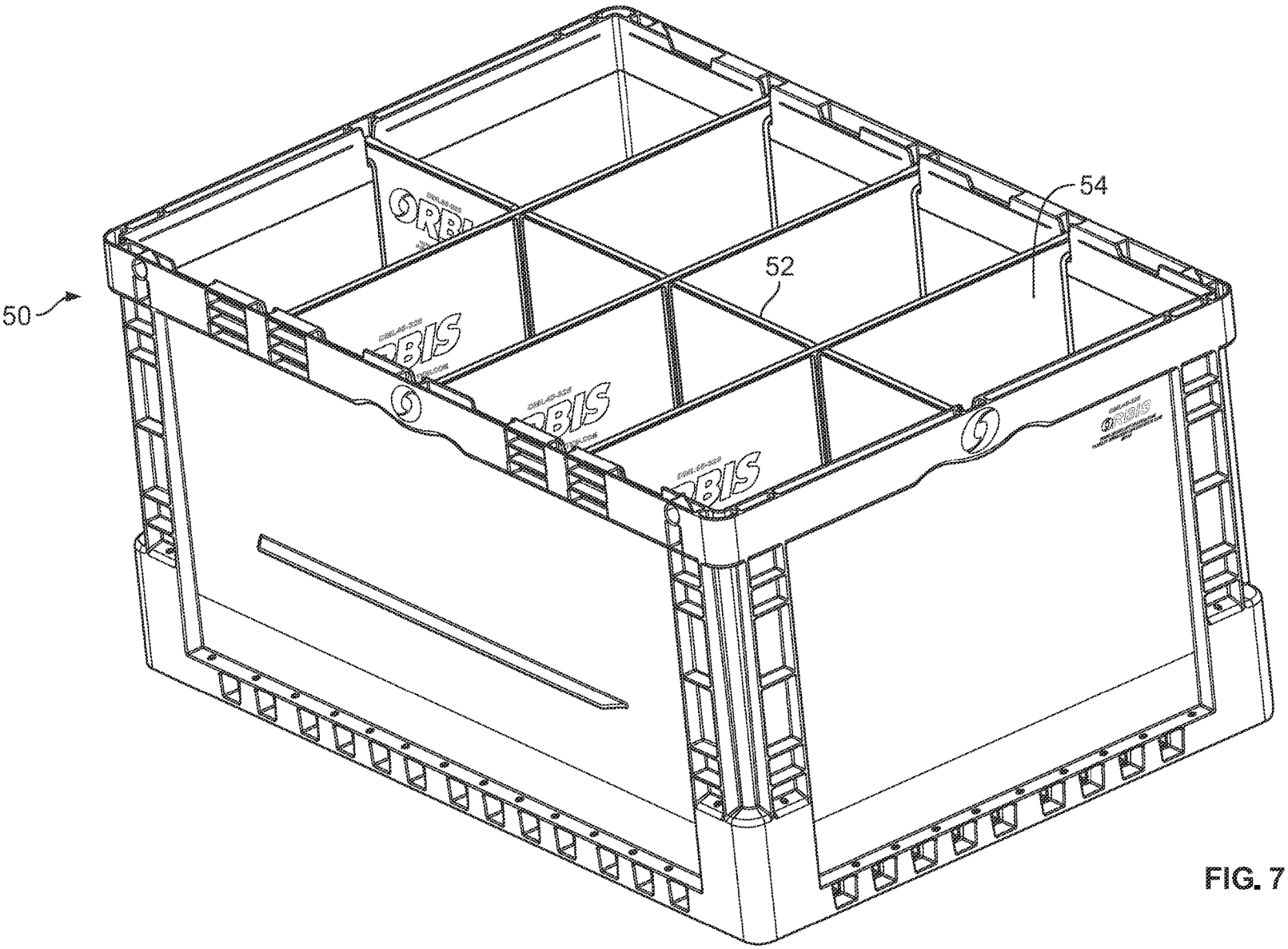
FIG. 7 is a perspective view of a container in accordance with the present invention having a drainage system in accordance with the present invention and intersecting divider panels with features for locking the panels along the length of the intersections between matching half slots in the divider panels.
Figure 8:
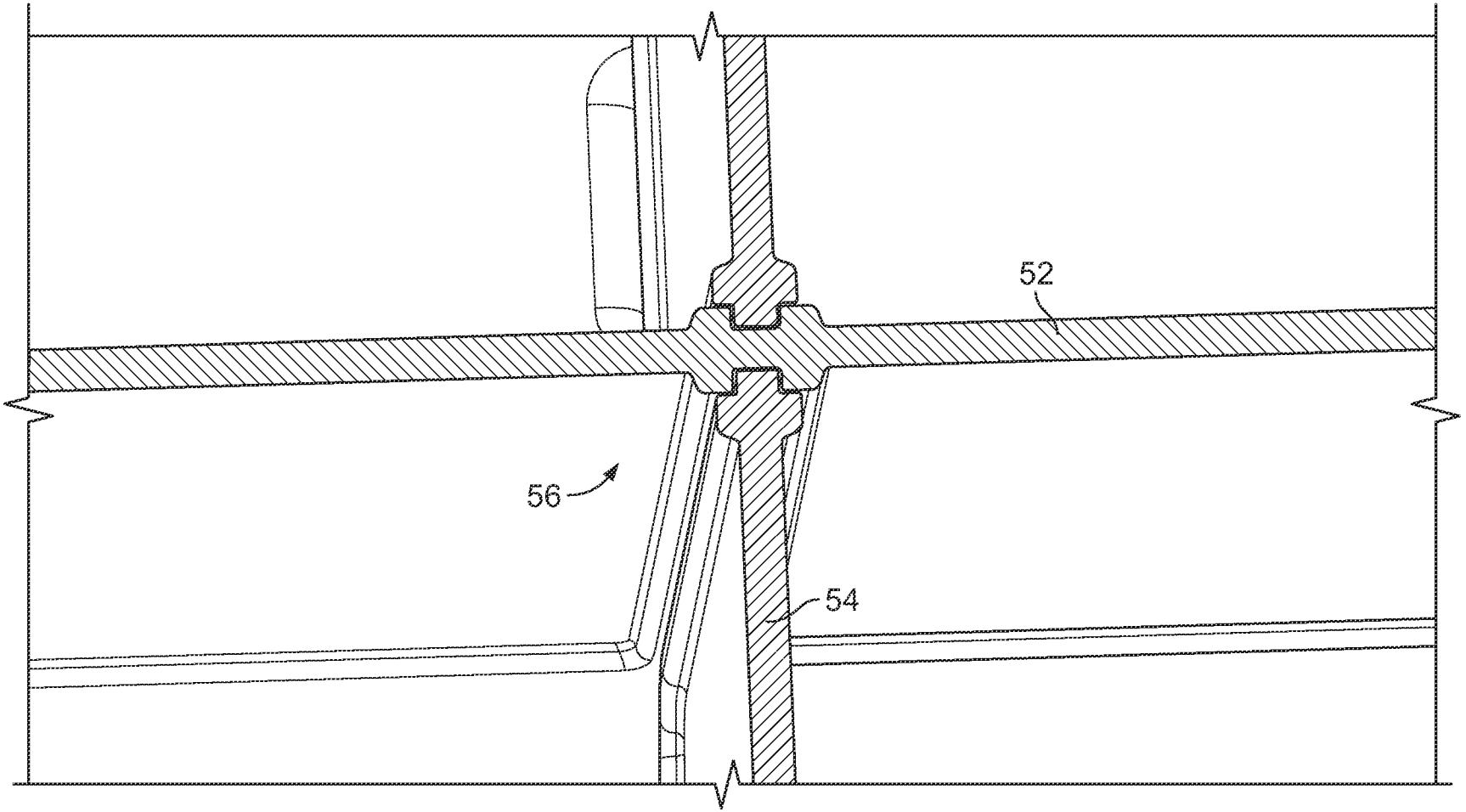
FIG. 8 is an enlarged cross-sectional view of a lower portion of the intersection; and, FIG. 9 is an enlarged cross-sectional view of an upper portion of the intersection.
Figure 9:
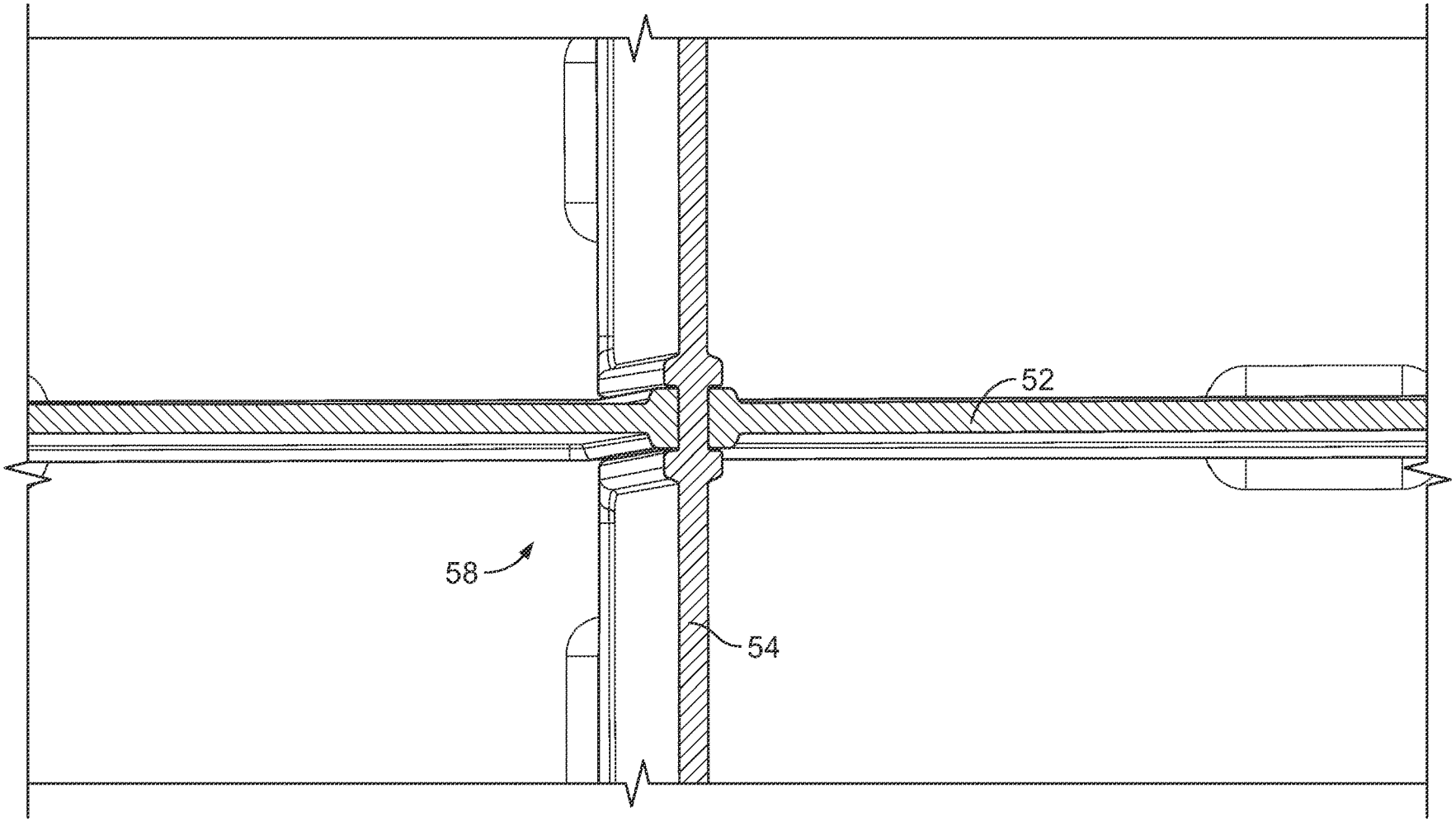

FIG. 7 discloses a container 50 having a drainage system in accordance with the present invention. Additionally, the container includes divider panels 52, 54 having structure at the intersections for preventing the upper or lower portions of the walls of the panels 52, 54 from flexing due to a load as provided in U.S. Provisional Patent Application No. 63/265,452 filed Dec. 15, 2021. FIG. 8 shows a cross-sectional view of the structure 56 for the lower portion of an intersection and FIG. 9 shows a cross-sectional view of the structure 58 of the upper portion of the intersection (the intersections are formed from corresponding half slots in each divider panel).

Many modifications and variations of the present invention are possible in light of the above teachings. It is, therefore, to be understood within the scope of the appended claims the invention may be protected otherwise than as specifically described.

I claim:

1. A tote with a drainage system for enabling even flow of liquid comprising:

a container body having a first end wall, an opposing second end wall, a first side wall and an opposing second side wall extending upwards from a bottom wall;

a bumper extending outward from the first end wall, second end wall, first side wall and second side wall around a lower portion of the container body, the bumper having a bottom horizontal wall and a top horizontal wall spaced a distance above the bottom horizontal wall;

a first drain hole in the first end wall spaced a first distance above a top surface of the bottom wall allowing liquid from an interior of the container body to exit through the bumper between the bottom horizontal wall and the top horizontal wall;

a first drain hole in the second end wall spaced the first distance above the top surface allowing liquid from the interior of the container body to exit through the bumper between the bottom horizontal wall and the top horizontal wall;

a first drain hole in the first side wall spaced the first distance above the top surface allowing liquid from the interior of the container body to exit through the bumper between the bottom horizontal wall and the top horizontal wall; and, a first drain hole in the second side wall spaced the first distance above the top surface allowing liquid from the interior of the container body to exit through the bumper between the bottom horizontal wall and the top horizontal wall, wherein the tote is configured to accumulate liquid in a bottom portion of the container body below the first distance before drainage occurs.

2. The tote of claim 1 further comprising a plurality of ribs extending upward from the top surface of the bottom wall.

3. The tote of claim 2 wherein the plurality of ribs comprises a plurality of spaced apart parallel ribs extending from proximate the first end wall to proximate the second end wall.

4. The tote of claim 3 wherein the plurality of ribs comprises a plurality of spaced apart parallel ribs extending from proximate the first side wall to proximate the second side wall.

5. The tote of claim 2 wherein each of the plurality of ribs extends upward a second distance that is less than the first distance.

6. The tote of claim 5 wherein the first distance is 0.5 inches.

7. The tote of claim 6 wherein the second distance is 0.45 inches.

8. The tote of claim 2 wherein the first end wall includes a second drain hole spaced the first distance above the top surface allowing liquid from the interior of the container body to exit through the bumper.

9. The tote of claim 8 wherein the second end wall includes a second drain hole spaced the first distance above the top surface allowing liquid from the interior of the container body to exit through the bumper.

10. The tote of claim 9 wherein the first side wall includes a second drain hole spaced the first distance above the top surface allowing liquid from the interior of the container body to exit through the bumper.

11. The tote of claim 10 wherein the second side wall includes a second drain hole spaced the first distance above the top surface allowing liquid from the interior of the container body to exit through the bumper.

12. The tote of claim 11 wherein each of the drain holes is D-shaped having a flat segment and an arcuate segment connected at a first end to a first end of the flat segment and at a second end to a second end of the flat segment.

13. The tote of claim 12 wherein the flat segment is oriented to a horizontal position with the arcuate segment above the flat segment.

14. The tote of claim 11 wherein the bumper includes a first horizontal upper wall extending outward from the container body and a second lower horizontal wall extending outward from the container body and wherein the drain holes are between the first wall of the bumper and the second wall of the bumper.

15. The tote of claim 14 wherein the bumper includes a plurality of segments extending outwardly from the container body between the drain holes.

16. The tote of claim 1 wherein the tote is formed from plastic.

17. A tote having a drainage system comprising:

a container body having a first end wall, an opposing second end wall, a first side wall and an opposing second side wall extending upwards from a bottom wall;

a bumper extending outward from the first end wall, second end wall, first side wall and second side wall around a lower portion of the container body, the bumper having a bottom horizontal wall and a top horizontal wall spaced a distance above the bottom horizontal wall;

a first plurality of drain holes in the first end wall spaced a first distance above a top surface of the bottom wall allowing liquid from an interior of the container body to exit through the bumper between the bottom horizontal wall and the top horizontal wall;

a second plurality of drain holes in the second end wall spaced the first distance above the top surface allowing liquid from the interior of the container body to exit through the bumper between the bottom horizontal wall and the top horizontal wall;

a third plurality of drain holes in the first side wall spaced the first distance above the top surface allowing liquid from the interior of the container body to exit through the bumper between the bottom horizontal wall and the top horizontal wall; and, a fourth plurality of drain holes in the second side wall spaced the first distance above the top surface allowing liquid from the interior of the container body to exit through the bumper between the bottom horizontal wall and the top horizontal wall, wherein the tote is configured to accumulate liquid in a bottom portion of the container body below the first distance before drainage occurs.

18. The tote of claim 17 wherein each of the drain holes is D-shaped having a flat segment and an arcuate segment connected at a first end to a first end of the flat segment and at a second end to a second end of the flat segment.

19. The tote of claim 18 wherein the bumper includes a first horizontal upper wall extending outward from the container body and a second lower horizontal wall extending outward from the container body and wherein the drain holes are between the first wall of the bumper and the second wall of the bumper.

20. The tote of claim 18 wherein the tote is formed from plastic.

* * * * *